US005289601A

United States Patent [19]

LaBianco

[11] Patent Number: 5,289,601

[45] Date of Patent: Mar. 1, 1994

[54] INTERLOCKING FOAM WATERBED MATTRESS

[76] Inventor: Richard A. LaBianco, 318 Driftwood Rd., Corona Del Mar, Calif. 92625

[21] Appl. No.: 379,638

[22] Filed: Jul. 13, 1989

[51] Int. Cl.[5] ..... A47C 27/08

[52] U.S. Cl. ..... 5/451; 5/917

[58] Field of Search ..... 5/451, 452, 450, 400, 5/401, 460, 917

[56] References Cited

U.S. PATENT DOCUMENTS

| | | | |
|---|---|---|---|
| 4,057,862 | 11/1977 | LaBianco | 5/460 |
| 4,221,013 | 9/1980 | Echevarria | 5/451 |
| 4,389,741 | 6/1983 | Larson | 5/460 |
| 4,506,397 | 3/1985 | Fogel et al. | 5/460 |
| 4,602,396 | 7/1986 | Fraige | 5/451 |
| 4,745,646 | 5/1988 | Strobel | 5/460 |

*Primary Examiner*—Alexander Grosz

*Attorney, Agent, or Firm*—Fulwider Patton Lee & Utecht

[57] ABSTRACT

A waterbed mattress having an inner frame formed with a bladder cavity encircled by an outer foam frame which covers the bladder cavity and extends downwardly to define the sides and ends of the mattress. An interlocking complementary protrusion and recess connection are interposed between the inner and outer frames to permit the peripheral portion of the outer frame and inner frames to be lifted sufficiently that bedding may be tucked thereunder. The outer frame is then lowered and the weight of the bladder is transferred by the connection to the outer frame so as to securely hold the bedding in place. The connection is releasable to permit the upper frame to be lifted off the lower frame for access to the bladder cavity.

11 Claims, 2 Drawing Sheets

INTERLOCKING FOAM WATERBED MATTRESS

The present invention relates generally to waterbeds and more particularly pertains to foam mattresses which contain and enclose water-filled bladder means.

BACKGROUND OF THE INVENTION

Development and improvement in the design and construction of waterbeds has progressed to a point where such devices are more accurately to be referred to as flotation sleep systems. Such a term refers to a liquid-filled bed consisting of a conventional ticking cover, a soft-sided frame intended to contain a water mattress, a water mattress, and a water mattress liner provided to capture and contain the liquid in the supporting structure should rupture occur to the water mattress. In addition, most such systems incorporate a heating element by which a comfortable temperature can be maintained within the supporting liquid. Recent developments have produced designs which have the advantages of waterbeds without the disadvantages of high heating costs, a non-conventional look, or the need for special linens and blankets. Some flotation sleep systems have controlled head-to-foot and side-to-side liquid movement, are lighter in weight using less water, adapt to existing bedroom furniture and use conventional bedding.

A type of design gaining increasing popularity is generally described in U.S. Pat. No. 4,221,013. This particular type of construction locates a water filled bladder or plurality of water filled bladders within an inner foam framework. The inner foam framework supports or cradles the water filled elements from below by extending across the entire bottom and up along the periphery of the mattress. An outer foam frame and cover encloses the entire structure from above and is configured to slip down over the outside of the inner framework's side walls. An inherent disadvantage of such a construction is that the outer cover slips off the inner framework as easily as it is slipped thereon. Consequently, any bedding that is merely tucked under the outer framework is easily dislodged. The inner framework acts as a barrier effectively preventing bedding from being tucked in any further than the width of the outer framework. Since the inner framework is disposed under and within the outer framework and top cover, the inner framework cannot be grasped and lifted so as to allow the insertion of bedding thereunder. Solutions to conveniences or disadvantages of this nature would allow waterbeds to continue gaining in popularity.

SUMMARY OF THE INVENTION

The general purpose of the present invention is to provide a waterbed mattress employing an inner frame and an outer foam frame to envelope liquid-filled bladder means that allows bedding to be neatly tucked under both the inner and outer frames to be firmly held in place. To attain this purpose, the mattress of the present invention includes an interlocking recess and complementary protrusion connection at the interface of the two frames. In addition, a stiffening element disposed within the outer foam frame member in proximity to the interlocking connection inhibits distortion of the foam material, facilitates manipulation of the outer frame member and restrains inadvertent disengagement of the inner and outer frame members from one another.

When the outer periphery of the mattress is grasped and lifted, the inner frame member is lifted or tilted in conjunction therewith thereby allowing the bedding to be tucked into a point well under the mattress. The weight of the liquid-filled bladder bearing down on the inner member is transferred to the outer frame member to insure that the bedding will not readily pull loose from under the mattress. The interlocking connection is readily releasable, however, to permit the outer frame to be separated from the lower frame to afford access to the bladder.

BRIEF DESCRIPTION OF THE DRAWINGS

Other objects and many of the attendant advantages of the present invention will be readily appreciated by reference to the following detailed description when considered in conjunction with the accompanying drawings in which like-referenced numerals designate like parts throughout the figures thereof.

DETAILED DESCRIPTION

The drawings generally illustrate two forms of mattresses M and M-1 embodying the present invention. As will be apparent from FIGS. 1 and 4, the mattresses each have the external appearance of a conventional mattress and are adapted to be placed on a suitable supporting structure and fitted with bedding material in a conventional manner.

Figure 1:
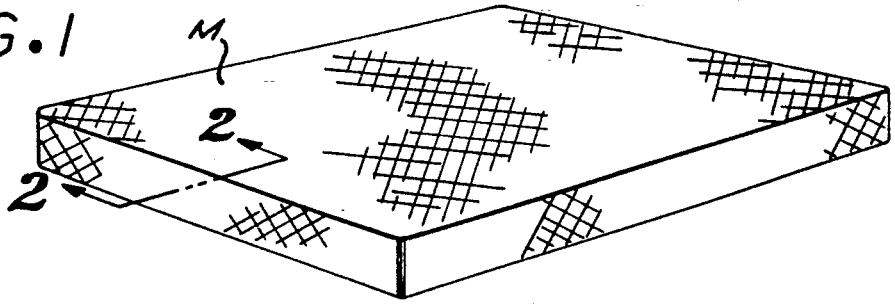
FIG. 1 is a perspective view of a mattress embodying the present invention.
Figure 2:
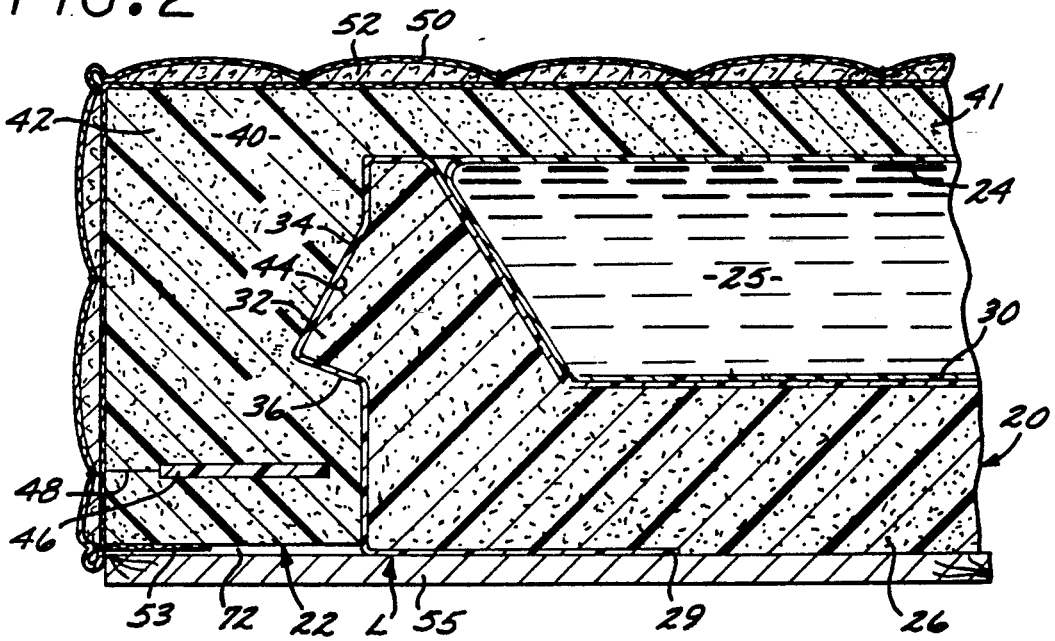
FIG. 2 is an enlarged cross-section taken along lines 2—2 of FIG. 1.
Figure 3:
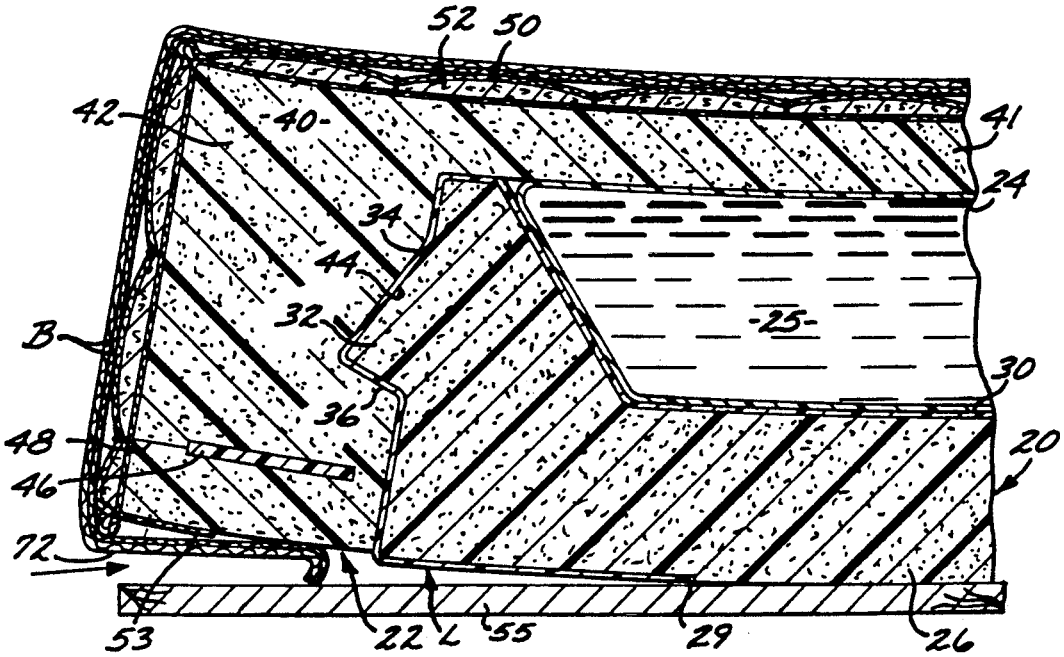
FIG. 3 is a view similar to FIG. 2 demonstrating how the mattress is lifted to allow bedding to be inserted thereunder.

More particularly, and with reference to FIGS. 1-3, there is shown a first form of mattress M embodying the present invention. FIG. 2 illustrates the internal construction of such mattress. The mattress M includes an inner frame member, generally designated 20, an outer frame member, generally designated 22, and a water-filled bladder means generally designated 24. Inner frame member 20 includes a foam body 26 about which extends a waterproof liner L. The inner frame member is dished-out to define a cavity 30 which receives the bladder means 24. Bladder means 24 may take the form of a single bladder or alternatively a plurality of individual bladders adapted to be filled with a liquid such as water. The inner frame member 20 is provided with an outwardly extending generally triangular protrusion 32 about its entire periphery. Preferably, protrusion 32 is configured substantially as shown in FIG. 2, wherein the upper face 34 is shown angled outwardly and downwardly while the lower face 36 is shown angled outwardly and upwardly, at a shallower angle than upper face 34.

Liner L is formed of a suitable synthetic plastic such as PVC or ABS. Its purpose is to contain any water leaking from bladder means 24 and prevent such leakage from seeping into the mattress and potentially into the room housing the waterbed. As indicated in FIG. 2, liner L closely conforms to the outer surface of foam body 26 except that its lowermost wall terminates at 29 inwardly from the lower outer periphery of the foam body.

The outer frame member 22 includes a foam body 40 having a top panel 41 which covers the bladder means 24 and from the periphery of which depends a vertical wall 42. The inner intermediate portion of wall 42 is formed with a generally triangular recess 44 at the interface between the lower frame member and the outer frame member. Recess 44 is complementary to and removably receives the protrusion 32. The lower portion of vertical wall 42 of outer frame member 22 is provided with a flat stiffener 46 positioned within an inwardly extending horizontal slot 48 formed in the vertical wall whereby the stiffener may be inserted into the lower portion of the vertical wall by a horizontal sideward and inward movement relative to the foam body 40. A stiffener 46 may be provided for both sides and the ends of the upper foam body 40 of the outer frame member. Such stiffeners will extend along all or at least the major portion of the length of the vertical wall of the sides and ends of the frame body 40. Stiffeners 46 may be formed of a suitable semi-rigid or rigid plastic such as polycarbonate. The foam bodies 26 and 41 may be formed of a suitable conventional material such as an open cell polyurethane foam. The exterior of mattress M is covered by a conventional quilted cover 50 having a ticking material 52 that has its edges 53 adhered to the underside of the peripheral portion of the outer frame member 22.

Referring now to FIG. 3, when bedding B is to be fitted over the mattress M, the person performing such task places one hand under a point located on the underside of the outer frame member 22 and lifts same sufficiently that the peripheral portion of the bedding B can be forced horizontally below the vertical wall 42 of the outer frame member and above base 55 which supports mattress M, as indicated by the arrow. Such lifting movement will also lift the peripheral portion of the inner frame member 20 because of the interlocking connection provided by the mating of protrusion 32 with recess 44. This lifting action is facilitated by the provision of the stiffener 46. When the bedding has been properly positioned, the outer portion of the mattress M is lowered whereby the bedding B is held securely in place by the weight of the mattress, and particularly the weight of the water contained within bladder 24.

The size and shape of the interlocking connection between protrusion 32 and recess 44 should be so chosen that the outer frame member 22 can be readily removed from the inner frame member 20 to permit access to the bladder cavity 30. With the arrangement shown in FIGS. 2 and 3, the foam adjacent recess 44 will slip over the protrusion 32 when the vertical wall 42 of the outer frame member has been lifted approximately eight inches off of the mattress base 54 and the outer frame member will then slip off the inner frame member because of the flexibility of the foam material. The outer frame member may be readily reapplied to the inner frame member by merely forcing the peripheral portion of the outer frame member downwardly over the inner frame member.

Figure 4:
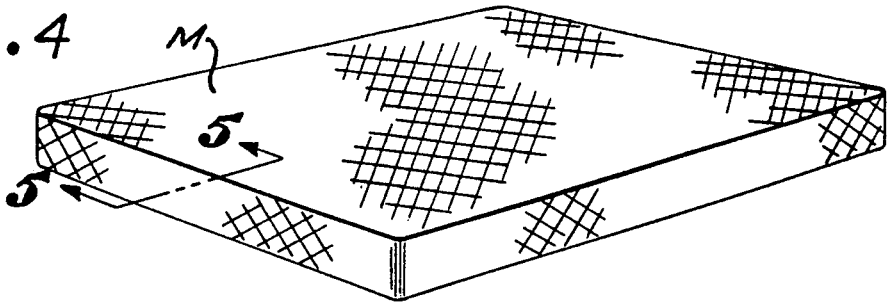
FIG. 4 is a perspective view of a second form of mattress embodying the present invention.
Figure 5:
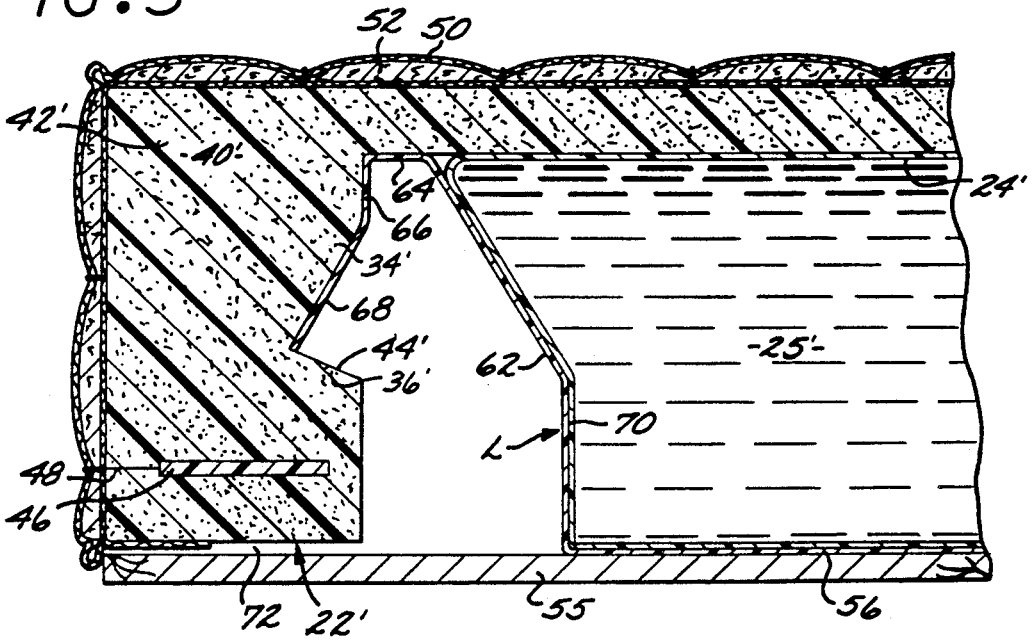
FIG. 5 is an enlarged cross-section taken along lines 5—5 of FIG. 4.
Figure 6:
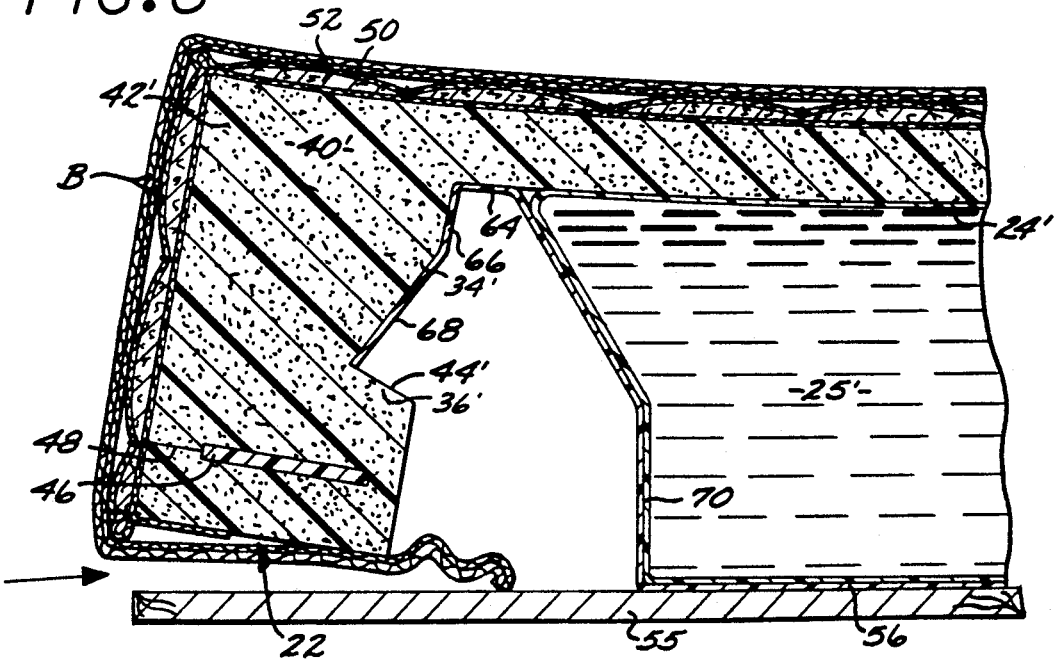
FIG. 6 is a view similar to FIG. 5 demonstrating how the mattress is lifted to allow bedding to be inserted thereunder.

Referring now to FIGS. 4, 5 and 6, there is shown a second form of mattress M-1 embodying the present invention. The modified mattress is similar to the mattress M of FIGS. 1, 2 and 3. In particular, the outer frame member 22' is identical to outer frame member 22 of FIGS. 1 and 3, and like parts bear the same reference numerals. It will be noted that the inner frame member 56 of FIGS. 1, 2, and 3 does not include a foam body. Instead, the inner frame member consists solely of a semi-rigid liner L' formed of a suitable synthetic plastic such as ABS or fiberglass to contain leakage from bladder 24. This liner includes a horizontal bottom 58 which rests upon base 55, and the outer periphery of the liner extends upwardly from a bottom wall 58 to define a vertical wall 60, and an upwardly and outwardly extending wall 62. A horizontal outwardly extending shoulder 64 is formed at the top of wall 62, from which there depends a vertical portion 66, the lower edge of which extends outwardly and downwardly to define a locking finger 68. Bladder means 24' are contained within the cavity 70 defined by the inwardly-facing surfaces of the liner. The outwardly and downwardly extending locking finger 68 extends into the upper face 34' of generally triangular recess 36' formed in the vertical wall 42' of the foam body 40' of outer frame member 22'.

Referring to FIG. 6, the operation of placing bedding B about the mattress M-1 is the same as described in connection with mattress M. Thus, the underside of the outer frame member 22' is lifted off base 55 so that the peripheral portion of bedding B can be forced horizontally below the vertical wall 42' of the outer frame member. As indicated by this figure, upward movement of vertical wall 42' will flex the locking finger 68 upwardly to permit such upward movement of the outer portion of the outer frame member. As with the mattress of FIGS. 1, 2, and 3, continued lifting of the vertical wall 42' will cause the foam adjacent recess 44' to flex and thereby release the connection between the inner and outer frames. In this manner access to bladder cavity 70 is made possible. With reference to both FIGS. 3 and FIG. 6, it should be noted that the underside of the vertical walls 42, 42' may terminate a short distance above base 55 to define a space 70 to accommodate the thickness of bedding B.

Various modifications and changes may be made with respect to the foregoing detailed description without departing from the spirit of the present invention.

I claim:

1. A waterbed mattress for use with bedding, said mattress comprising:

an inner frame member formed with wall means that define a cavity;

bladder means within the cavity of the inner framework;

an outer frame member having a foam body that includes a top panel which covers the bladder means, with a vertical wall depending from the edges of top panel to abut the periphery of the wall means of the inner frame member;

connection means between the wall of the inner and outer frame members, said connection means including a recess and a protrusion, said recess being complementary to the protrusion to define a releasable locking means normally securing the outer frame member to the inner frame member whereby a lifting movement applied to the outer frame member will raise the outer portion of the inner frame member to permit the peripheral portion of the bedding to be inserted and retained underneath the mattress, with said releasable connection means being so configured that upon continued lifting of the outer frame member the foam in the area of the recess will deform to disengage the locking means whereby the outer frame member can be removed from the inner frame member to permit access to the bladder cavity.

2. A waterbed mattress as set forth in claim 1 which further includes a stiffener disposed within the walls of the outer frame member.

3. A waterbed mattress as set forth in claim 2 wherein said protrusion and completmentary recess are of generally triangular configuration.

4. A waterbed mattress as set forth in claim 2 wherein said protrusion is formed on the periphery of the inner frame member wall and the complementary recess is formed on the interior of the outer frame member wall.

5. A waterbed mattress as set forth in claim 1 wherein said protrusion and complementary recess are of generally triangular configuration.

6. A waterbed mattress as set forth in claim 1 wherein said protrusion is formed on the perimeter of the inner frame member wall and the complementary recess is formed on the interior of the outer frame member wall.

7. A waterbed mattress as set forth in claim 4 wherein the upper face of said protrusion is angled outwardly and downwardly and the lower face of said protrusion is angled outwardly and upwardly at a shallower angle than the upper face.

8. A waterbed mattress as set forth in claim 7 which further includes a stiffener disposed within the walls of the outer frame.

9. A waterbed mattress as set forth in claim 8 wherein the inner frame member includes a foam body confined within a liner.

10. A waterbed mattress as set forth in claim 8 wherein the inner frame member is defined by a substantially rigid liner.

11. In a mattress construction, a water mattress, a resilient peripheral cushion extending about said water mattress, a flexible cover for said resilient cushion, said resilient cushion including a peripheral inner rail and a peripheral outer rail, the interior surface of the inner rail providing peripheral support for said water mattress, said inner rail and outer rail including facing generally vertical surfaces, and interengaging means on each of said facing generally vertical surfaces, interlocking said surfaces thereby preventing relative vertical movement between said inner and outer rails.

* * * * *